United States Patent [19]

Erfer

[11] 4,218,154

[45] Aug. 19, 1980

[54] WRITING INSTRUMENT WITH SELF-CLOSURE

[76] Inventor: David Erfer, 412 Yale Ave., Broomall, Pa. 19008

[21] Appl. No.: 918,714

[22] Filed: Jun. 26, 1978

[51] Int. Cl.[2] ..... B43K 24/00

[52] U.S. Cl. ..... 401/107

[58] Field of Search ..... 401/107, 108, 68

[56] References Cited

U.S. PATENT DOCUMENTS

| | | | |
|---|---|---|---|
| 350,037 | 9/1886 | Bussler | 401/108 |
| 1,580,987 | 4/1926 | Alford | 401/108 |
| 1,714,965 | 5/1929 | Ullner | 401/107 |
| 1,734,784 | 11/1929 | Vierling et al. | 401/68 |
| 2,111,767 | 3/1938 | Gimonet | 401/107 |
| 2,590,943 | 4/1952 | Coskey et al. | 401/116 |
| 2,591,537 | 4/1952 | Gordon | 401/107 |
| 2,941,511 | 6/1960 | Cieremans | 401/107 |
| 3,445,171 | 5/1969 | Seidler | 401/108 |
| 3,525,573 | 8/1970 | Fend | 401/108 |
| 3,583,820 | 6/1971 | Koein | 401/107 |

FOREIGN PATENT DOCUMENTS

| | | | |
|---|---|---|---|
| 1400781 | 7/1975 | United Kingdom | 401/108 |

*Primary Examiner*—William Pieprz

[57] ABSTRACT

A writing instrument includes a self-closure provided by a plurality of segment members which, when operably disposed, form a protective enclosure for the writing tip and, when not operably disposed, retract within the barrel of the instrument.

9 Claims, 4 Drawing Figures

32
34
12
22
14
24
30
62
64
10
26
46
44
16
18
48
50
3
58
20
56
60
43
28
38
54
40
36

32
34
12
22
14
24
30
26
64
10
46
44
16
18
50
48
4
58
60
20
56
38
28
43
40
36
54

16
48
50
54
52
42
26
38
40

16
48
50
54
52
42
26
38
40

WRITING INSTRUMENT WITH SELF-CLOSURE

BACKGROUND OF THE INVENTION

This invention relates generally to writing instruments, and more particularly to a novel writing instrument which includes a self-closure.

Numerous kinds of writing instruments are presently available on the market. For example, the relatively inexpensive felt-tip or plastic-tip "marker" pens enjoy a wide popularity. Ball-point pens, which have been available for many years, are also widely sold, and increasingly popular are roller pens, which combine features of fountain pens and fiber tip pens in a tip which operates on a ball-point principle. Traditional liquid reservoir fountain pens retain a measure of popularity, and other liquid ink types of pens are also used for drafting and technical applications.

Inadvertent contact with the tips of any of the above types of writing instruments is undesirable for obvious reasons, and, accordingly, provision is usually made for protection of the tip. This is typically done by the provision of caps, or sometimes, in the case of conventional ball-points, by providing a mechanism for retractability.

The use of caps involves a degree of inconvenience and risk of loss, and with some types of instruments, the loss of the cap means, for all practical purposes, that the instrument itself can no longer be used.

It is a general object of this invention, therefore, to provide a writing instrument which is provided with an integral, non-separable self-closure. Other specific objects will appear hereinafter.

The general and other objects of this invention are realized, in a presently preferred form of the invention, by a writing instrument provided with the usual barrel, a writing tip disposed in the barrel, and a closure comprising a plurality of segment members having tapered lower end portions which come together to form a hollow protective enclosure for the writing tip. Closure actuating means are provided for moving the segment members in relation to the barrel between a first position in which the segment members are operatively disposed and another position in which the segment members are retracted so as to permit exposure of the writing tip. In present contemplation, the writing tip may itself be retractable, so that when the self-closure is in its retracted position, the writing tip may be projected from the barrel for use.

For the purpose of illustrating this invention, there is shown in the drawings a form of the invention which is presently preferred, but it should be understood that the invention is not limited to the precise arrangement and instrumentalities shown.

Figure 1:
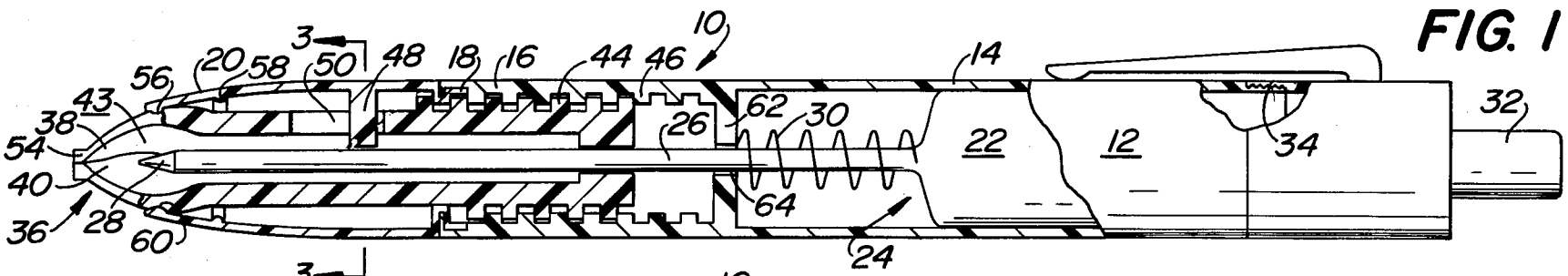
FIG. 1 is a side elevation view, in partial cutaway and cross-section, of a writing instrument which embodies the present invention.
Figure 2:
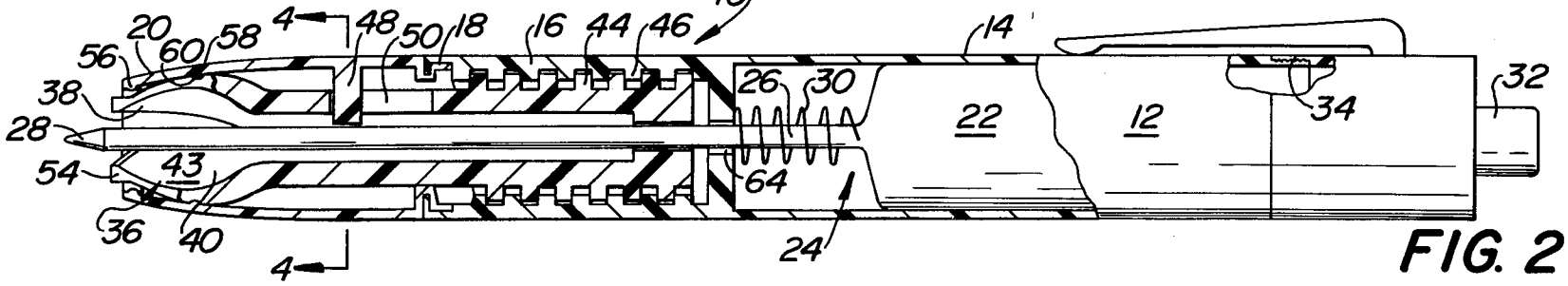
FIG. 2 is a view similar to that of FIG. 1, showing the apparatus of the present invention in another condition of operation.

Referring now to the drawings in detail, wherein like reference numerals indicate like elements, there is seen in FIGS. 1 and 2 a writing instrument designated generally by the reference numeral 10.

The writing instrument 10 includes a barrel 12 consisting in the illustrated form of the invention of an upper portion 14 and a lower portion 16, the two portions being axially aligned and rotatably interconnected, as by means of a snap or other such rotatable joint 18. The lower portion 16 of the barrel 12 is provided with a reduced diameter nose portion 20, the function of which will be explained in detail below.

Disposed within the barrel 12 of the writing instrument 10 is a writing cartridge designated generally by the reference numeral 22, typically including a reservoir 24, a neck portion 26 and a writing tip 28. The cartridge 22 may be of any number of well-known types, including, by way of illustration, the so-called "marker" (or fiber tip), ball-point, "rolling writer" or even fountain types. It should be understood that "writing" is used here in its broadest sense, and that the present invention may be used with other kinds of writing or marking instruments such as brushes or the like, and that for the purposes of this disclosure and the appended claims, such instruments are deemed to fall within the general expression "writing tip".

Disposed within the upper portion 14 of the barrel 12 is a retracting mechanism, which may be of any conventional type, and is not, therefore, shown in detail. The retracting mechanism will typically include a return spring, exemplified by the spring 30 in FIGS. 1 and 2, and an actuator button 32. The upper portion 14 of the barrel 12 may also be provided with means such as screw threads 34 by which the upper portion 14 may be opened to facilitate removal and replacement of the cartridge 22.

Also disposed within the barrel 12 and cooperating with it in a manner which will now be described in detail, is a self-closure designated generally by the reference numeral 36. The self-closure 36 is made up of a plurality of individual movable segment members 38, 40, and 42, each of like construction, interconnected at their respective upper ends by a ring-like web structure.

The segment members 38, 40, and 42 include lower end portions 43, which, when the self-closure 36 is operatively disposed, define a hollow protective enclosure for the writing tip 28. The segment members 38, 40, and 42 also have, adjacent their respective opposite ends, external screw threads portions 44, the screw thread portions 44 being complemental and in operative engagement with an internal thread 46 within the upper portion 14 of the barrel 12.

As will be seen in FIGS. 1 and 2, respective lower end portions 43 of the segment members 38, 40, and 42 project into and beyond the nose portion 18 of the lower barrel portion 16. The segment members 38, 40, and 42 are movable between what may be called for convenience: a first position, in which the segment members 38, 40, and 42 are operatively disposed to provide a closure for the tip 28, and another position in which segment members 38, 40, and 42 are retracted to a position which permits projection and exposure of the tip 28. In the second-mentioned position, the segment members 38, 40 and 42 are substantially fully enclosed within the lower portion 16 of the barrel 12.

Movement of the self-closure 36 is accomplished, in the illustrated embodiment, by rotation of the lower portion 16 of the barrel 12, together with the self-closure 36, relative to the upper portion 14 of the barrel 12. To secure rotation of the self-closure 36 (and members 38, 40, and 42) with the lower portion 16, there are provided, in the illustrated embodiment, fingers 48 extending inwardly from the inner wall of the lower portion 16 of the barrel 12. As is perhaps best seen in FIGS. 3 and 4, the fingers 48 extend through elongated axially extending slots 50 in the segment members 38, 40, and 42, the width of the slots corresponding generally to the thickness of the fingers 48. Thus, upon rotation of the lower portion 16 of the barrel 12 relative to the upper portion 14, the fingers 48 bear on the sides of the slots 50, thus also rotating the segment members 38, 40, and 42 with the lower portion 16 in the desired manner. Relative rotation of the screw thread portions 44 with respect to the fixed internal thread 46 of the upper barrel portion 14 causes projection or retraction of the segment members 38, 40, and 42.

Figure 4:
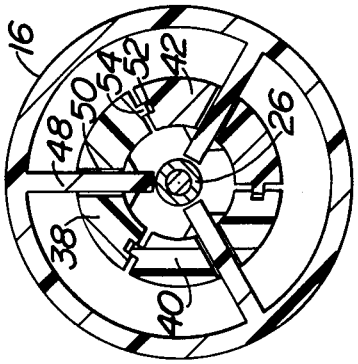
FIG. 4 is a cross-sectional view taken along the line 4—4 in FIG. 2.
Figure 3:
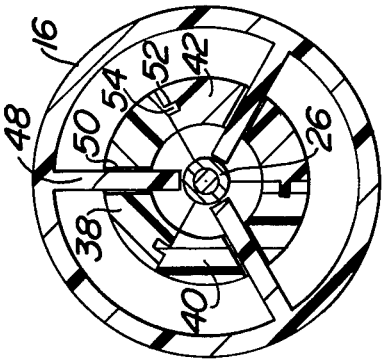
FIG. 3 is a cross-sectional view taken along the line 3—3 in FIG. 1.

Referring again to FIGS. 1 and 2, it will be seen that as the segment members 38, 40, and 42 are projected outwardly toward their operative position, the inner surface of the reduced diameter nose portion 20 of the lower barrel portion 16 contacts their respective outer surfaces and wedges or cams their lower end portions toward one another so that they are pressed tightly into edge-to-edge engagement as they assume the position seen in FIG. 1. To aid alignment of the segment members 38, 40, and 42, they may be provided at portions of their respective side edges with tongue and groove slots and projections 52, 54, seen in FIGS. 3 and 4. With reference to FIGS. 3 and 4, the tongue and groove slots and projections are loosely interengaged when the segment members are in their retracted position (corresponding to FIG. 4), and more tightly and sealingly interengaged when the segment members 38, 40, and 42 are in their operative positions.

In the preferred embodiment of the invention, the segment members 38, 40, and 42 are provided with enlarged nose portions 54, the purpose of which is to blunt the point formed at their apex thus providing a measure of protection against damage to the clothing of the user of the instrument 10.

Referring again to FIGS. 1 and 2, there are seen details by which the first and "other" (retracted) positions of the segment members 38, 40, and 42 are established.

Disposed within the nose portion 20 are a pair spaced annular rings 58 and 60, the ring 56 being disposed adjacent the opening in the nose portion 20, and the ring 58 being spaced from and parallel to the ring 56 and spaced from it by a distance corresponding to the distance of linear movement of the segment members 38, 40, and 42 from the open to the other position. The segment members 38, 40, and 42 are provided with peripheral segmental grooves 60, corresponding generally in size to the size of the annular rings 56 and 58, so that, with reference to FIG. 1, when the segment members 38, 40, and 42 are projected into their operative positions, the ring 56 rests in the peripheral grooves 60 of the segment members. Referring to FIG. 2, however, when the segment members 38, 40, and 42 are retracted, the annular ring 58 engages the peripheral grooves 60. Engagement of the annular rings 56 and 58 with the peripheral grooves 60 in the respective positions preferably provides a palpable or audible "click" and also a degree mechanical holding power to establish the desired limits of movement of the segment members 38, 40, and 42.

Referring to FIGS. 1 through 4, it will be seen that the cartridge 22 is supported within the barrel 12 by the above-mentioned fingers 48, which provide, in effect, a support or guideway for the neck portion 26 of the cartridge 22, and also by an internal wall 62, seen in FIGS. 1 and 2. The wall 62 includes a bore 64, through which the neck portion 26 of the cartridge 22 can project. The return spring 30, in the illustrated form of the invention, also bears on the disc member 62.

The various parts of the writing instrument 10 may be made of any suitable materials, including, for example, common structural plastics having suitable molding and other mechanical properties or, where appropriate or desirable, cast, drawn or stamped metal. The segment members 38, 40, and 42, it should be understood, are of resilient materials, and in their unstressed condition tend to take the configuration shown in FIG. 2. Projection of the segment members 38, 40, and 42 to the position shown in FIG. 1, against the camming action provided by the nose portion 20 bends the segment members 38, 40, and 42 against their natural bias.

The present invention may be embodied in other specific forms without departing from its spirit or essential attributes, and, accordingly, reference should be made to the appended claims rather than the foregoing specification for indication as to the scope of the invention.

I claim:

1. A writing instrument having a barrel, a writing tip disposed in said barrel, a retracting mechanism for said writing tip, and a self-closure operatively associated with said barrel and said writing tip; said closure comprising a plurality of resilient segment members having tapered lower end portions, said lower end portions being complemental with each other when said segment members are operatively disposed so as to define a hollow protective enclosure for said writing tip, and closure-actuating means interconnecting said barrel and said segment members for moving said segment members in relation to said barrel between a first position in which said segment members are operatively disposed and another position in which said segment members are retracted so as to permit exposure of said writing tip, said closure-actuating means comprising screw thread portions disposed in said barrel, screw thread portions on said segment members complemental with said first-mentioned screw thread portions, means interconnecting said barrel and said segment members for rotating said segment members with respect to said first-mentioned screw thread portions, whereby said segment members may be moved between said positions and said barrel comprising an upper portion remote from said writing tip and a lower portion adjacent said writing tip and rotatably coupled to said upper portion in coaxial alignment therewith, said screw thread portions in said barrel being disposed in said upper portion, and said means interconnecting said barrel and said segment members comprising interlock means between said lower portion and said segment members so that said segment members rotate with said lower portion upon rotation of said lower portion with respect to upper portion.

2. Apparatus in accordance with claim 1, wherein said interlock means comprise elongated slots in said segment members, and finger members coupled to said lower portion and projecting into said slots.

3. Apparatus in accordance with claim 2, wherein said slots extend axially with respect to said segment members, and the width of said slots corresponds to the width of said finger members whereby said segment members are axially movable but not rotatable with respect to said lower portion.

4. Apparatus in accordance with claim 1, wherein said lower portion of said barrel comprises a nose portion of reduced diameter, and said lower end portions of said segment members have respective outer surface portions in camming relationship with said nose portion, so that said nose portion urges the lower end portions of adjacent segment members into edge-to-edge engagement with each other wherein said closure is operatively disposed.

5. Apparatus in accordance with claim 4, and detent means on said nose portion of said barrel and said segment members, said detent means on said nose portion and said segment members being interengaged when said segment members are operatively disposed.

6. Apparatus in accordance with claim 5, wherein said detent means comprises an annular ring within and projecting inwardly from said nose portion, and grooves on said lower end portions of said segment members, said grooves being complemental with said annular ring when said closure is operatively disposed.

7. Apparatus in accordance with claim 5, wherein said interlock means comprise elongated slots in said segment members, and finger members coupled to said lower portion and projecting into said slots.

8. Apparatus in accordance with claim 7, wherein said slots extend axially with respect to said segment members, and the width of said slots corresponds to the width of said finger members whereby said segment members are axially movable but not rotatable with respect to said lower portion.

9. Apparatus in accordance with claim 8, wherein said finger members project inwardly to provide support means for said writing tip.

* * * * *